United States Patent [19]

Ashok et al.

[11] Patent Number: 4,661,178

[45] Date of Patent: Apr. 28, 1987

[54] BETA COPPER BASE ALLOY ADAPTED TO BE FORMED AS A SEMI-SOLID METAL SLURRY AND A PROCESS FOR MAKING SAME

[75] Inventors: Sankaranarayanan Ashok, Bethany; John F. Breedis, Trumbull, both of Conn.

[73] Assignee: Olin Corporation, New Haven, Conn.

[21] Appl. No.: 749,835

[22] Filed: Jun. 28, 1985

Related U.S. Application Data

[62] Division of Ser. No. 598,960, Apr. 11, 1984, Pat. No. 4,555,272.

[51] Int. Cl.[4] ..... C22C 9/01

[52] U.S. Cl. ..... 148/435; 148/436; 420/469; 420/485; 420/486; 420/487; 420/489; 420/496

[58] Field of Search ..... 148/435, 436; 420/469, 420/485, 486, 487, 489, 496

[56] References Cited

U.S. PATENT DOCUMENTS

| | | | |
|---|---|---|---|
| 1,369,818 | 3/1921 | Kosugi | 420/486 |
| 1,496,269 | 6/1924 | Iytaka | 420/486 |
| 1,906,567 | 5/1933 | Fritschle | 420/489 |
| 2,430,419 | 11/1947 | Edens | 420/486 |
| 2,778,733 | 1/1957 | Frejacques | 420/489 |
| 2,789,900 | 4/1957 | Hannon | 420/486 |
| 2,798,826 | 7/1957 | Klement | 420/486 |
| 2,809,889 | 10/1957 | Heer et al. | 420/486 |
| 2,829,972 | 4/1958 | Klement | 420/486 |
| 3,091,527 | 5/1963 | Pollock | 420/486 |
| 3,176,410 | 4/1965 | Klement | 420/489 |
| 3,378,413 | 4/1968 | Ingerson | 148/160 |
| 3,902,544 | 9/1975 | Flemings et al. | 164/71 |
| 3,936,298 | 2/1976 | Mehrabian et al. | 75/10 R |
| 3,948,650 | 4/1976 | Flemings et al. | 75/10 R |
| 3,951,651 | 4/1976 | Mehrabian et al. | 75/10 R |
| 3,954,455 | 5/1976 | Flemings et al. | 75/10 R |
| 4,106,956 | 8/1978 | Bercovici | 148/11.5 A |
| 4,116,686 | 9/1978 | Mravic et al. | 148/11.5 C |
| 4,401,488 | 8/1983 | Prinz et al. | 148/435 |
| 4,415,374 | 11/1983 | Young et al. | 148/11.5 C |

FOREIGN PATENT DOCUMENTS

| | | |
|---|---|---|
| 249261 | 1/1963 | Australia . |
| 1289301 | 9/1972 | United Kingdom . |
| 1328783 | 9/1973 | United Kingdom . |
| 2042385A | 9/1980 | United Kingdom . |

OTHER PUBLICATIONS

"Rheocasting Processes", by Flemings et al., AFS International Cast Metals Journal, Sep. 1976, pp. 11–22.

"Die Casting Partially Solidified High Copper Content Alloys", by Fascetta et al., AFS Cast Metals Research Journal, Dec. 1973, pp. 167–171.

"Pre-Primary Phase Formation In Solidification of Nickel-Aluminum Bronze", by Feest et al., Metals Technology, Apr. 1983, vol. 10, pp. 121–124.

"Observations on the Structure and Properties of Wrought Copper-Aluminum-Nickel-Iron Alloy", by Cook et al., *Journal of the Institute of Metals,* vol. 80, pp. 419–434.

"Microstructural Characterization of Case Nickel Aluminum Bronze", by Culpan et al., *Journal of Materials Science,* (1978), pp. 1647–1657.

"Tempering of Cast Nickel-Aluminium Bronze", by Hasan et al., *Metal Science,* vol. 17, Jun. 1983, pp. 289–295.

"The Metallography of Fracture in Cast Nickel Aluminium Bronze", by Culpan et al., *Journal of Materials Science,* (1978), pp. 323–328.

"The Creep and Fatigue Properties of Some Wrought Complex Aluminium Bronzes", by McKeown et al., *Journal of the Institute of Metals,* vol. 83, pp. 69–79.

"The Fracture Toughness of a Nickel-Aluminium Bronze", by Barnby et al., *Journal of Materials Science,* (1977), pp. 1857–1861.

Article by Alexander et al., *Journal of the institute of Metals, vol. 61, pp. 83–102, vol. 63, pp. 163–189 and vol. 64, pp. 217–230.*

"Influence of Microstructure of the Stress-Strain Behaviour of Two-Phase Copper-Rich Cu-Al Alloys", by Linden, *Materials Science and Engineering, (1979), pp. 5–14.*

*Alloy Digest,* AMPCOLOY 570, Mar. 1980.

*Primary Examiner*—Veronica O'Keefe

*Attorney, Agent, or Firm*—Paul Weinstein; Howard M. Cohn; Barry L. Kelmachter

[57] ABSTRACT

A predominately beta phase copper base alloy which is adapted for forming in a semi-solid slurry condition. The alloy has a microstructure comprising discrete particles within a lower melting point matrix and consists essentially of from about 9% to about 10.5% by weight aluminum, at least about 10% by weight nickel and the balance essentially copper. In accordance with an alternative embodiment the nickel can be replaced on a one for one basis by iron within certain limits. The alloys are processed by chill casting with a cooling rate throughout the section of the casting comprising at least about 10° C./sec. The alloys as-cast or when reheated to a semi-solid exhibit a microstructure suitable for press forging.

8 Claims, No Drawings

BETA COPPER BASE ALLOY ADAPTED TO BE FORMED AS A SEMI-SOLID METAL SLURRY AND A PROCESS FOR MAKING SAME

This application is a division of application Ser. No. 598,960, filed Apr. 11, 1984, now U.S. Pat. No. 4,555,272.

The present invention relates to a predominately beta copper base alloy which is adapted to be formed as a semi-solid metal slurry. The forming operation preferably comprises press forging. Within desired ranges of composition the alloy is precipitation hardenable in the forged state to provide increased levels of strength. The alloys of this invention find particular application in articles such as cartridge cases although they may be useful in a wide variety of articles.

The present invention also relates to a process for making the aforenoted copper base alloy wherein the alloy is cooled during casting at a critically high rate in order to form a desired microstructure for forming as a semi-solid metal slurry.

In the manufacture of thin walled elongated high strength members such as cartridge cases, it is highly desirable to form the member from a material having physical properties capable of achieving certain desired objectives, i.e. sufficient fracture toughness to withstand the shock associated with firing, good formability so that the member can expand during firing and contract afterwards, high strength properties to form a reusable cartridge, etc.

In U.S. patent application Ser. No. 337,560 to Pryor et al. for a "Method And Apparatus For Forming A Thixoforged Copper Base Alloy cartridge Casing" and assigned to the assignee of the present invention, there is disclosed a range of copper base alloys consisting essentially of from about 3% to about 20% nickel and from about 5% to about 10% aluminum and the remainder copper, which are adapted to be formed by forging a semi-solid metal slurry of the alloy. The formed part may be aged hardened to provide high strength properties. Pryor et al. also disclose the application of the material and processing therein to the formation of thin walled members such as cartridge cases.

While the alloys of Pryor et al. have been found to be well suited to this application, it has now been found that within certain critical ranges of composition the alloy which is formed comprises a predominately beta alloy. It has surprisingly been found that by controlling the ccmposition of the alloy it is possible to form using the process of this invention in accordance with one aspect a press forgeable structure as cast or in accordance with another aspect of the invention to form such a structure upon reheating the alloy to the semi-solid metal slurry condition. The ability to form a press foregeable copper base alloy without the necessity of stirring during casting represents a significant advantage with respect to providing the alloy in small cross section sizes, for example, rod which is 1" or less and preferably ½" or less in diameter. Forming such small cross-sectional raterials by conventional stir casting is difficult. For press forging applications such as cartridge cases, however, the use of such small diameter slugs is desirable. Therefore, alloys in accordance with the present invention when processed as described herein are well suited for such applications because they can be formed into small diameter slugs without the difficulties associated with stir casting.

It is known that alloys which are capable of forming a semi-solid metal slurry can have thixotropic properties which are beneficial in improving tool life and reducing thermal shock effects during processing. A metal or alloy composition which is suitable for forming while in the state of a semi-solid slurry having thixotropic properties generally has a microstructure comprising solid discrete particles within a surrounding matrix having a lower melting point than the particles. With such an alloy the surrounding matrix is solid when the metal composition is fully solidified and is liquid when the metal composition comprises a semi-solid slurry made up of the solid discrete particles in the molten surrounding matrix.

The desired microstructure of the copper base alloy may be formed by any of a number of techniques. One technique involves casting the alloy while it is agitated or stirred, preferably by electromagnetic means. This technique which has sometimes been referred to as "rheocasting" or "thixocasting" is exemplified in U.S. Pat. Nos. 3,902,544, 3,948,650 and 3,954,455 all to Flemings et al., 3,936,298 and 3,951,651 both to Mehrabian et al., and 4,106,956 to Bercovici, U.K. Patent Application No. 2,042,385A to Winter et al. published Sept. 24, 1980 and the articles "Rheocasting Processes" by Flemings et al., *AFS International Cast Metals Journal,* September, 1976, pp. 11–22 and "Die Casting Partially Solidified High Copper Content Alloys" by Fascetta et al., *AFS Cast Metals Rescearch Journal,* December, 1973, pp. 167–171. In this technique the solid discrete particles comprise degenerate dendrites or nodules which are generally spheroidal in shape.

An alternative technique for providing a copper base alloy or other metal or alloy with the desired microstructure suited to semi-solid metal forming is disclosed in U.S. Pat. No. 4,415,374 to Young et al. In this patent the alloy is prepared from a solid metal composition having a directional grain structure which is heated to a temperature between its solidus and liquidus to produce a partially solid, partially liquid mixture. The mixture is then solidified to provide the desired microstructure comprising discrete spheroidal particles contained within a lower melting matrix. Finally, certain alloys by the very nature of their composition form the desired microstructure when cast without stirring or agitation. This approach is exemplified in U.S. Pat. No. 4,116,686 to Mravic et al. wherein a phosphor-bronze is provided which possesses a substantially non-dendritic grain structure in the cast condition.

In the Young et al. U.S. Pat. No. 4,415,374 it is disclosed that U.S. Pat. Nos. 3,988,180, 4,106,956 and 4,019,927 describe heating an alloy to just above the solidus temperature and holding the alloy at that temperature until the dendritic phase becomes globular. Similarly, Young et al. U.S. Pat. No. 4,415,374 also disclose that a U.S. patent application Ser. No. 363,621, filed Mar. 30, 1982 by Gullotti et al. is directed to a process in which the starting material is a billet having a slurry cast structure and the slurry cast structure is rehabilitated by heating to a semi-solid state.

In the field of copper alloys numerous patents exist covering alloys containing additions of nickel and aluminum as well as alloys wherein a portion of the nickel is replaced by iron. Such alloys containing high amounts of aluminum are often referred to as aluminum-bronzes. U.S. Pat. Nos. 1,369,818 to Kosugi, 1,496,269 to Iytaka, 2,430,419 to Edens and 2,798,826 and 3,176,410 to Klement are particularly exemplary of such alloys. In addition to the aforenoted patents numerous publications exist relating to such copper base alloys as, for example, "Observations On The Structure And Properties Of Wrought Copper-Aluminium-Nickel-Iron Alloys" by Cook et al., *Journal Of The Institute Of Metals.* Vol. 80, Pages 419–434, "Pre-primary Phase Formation In Solidification Of Nickel-Aluminium Bronze" by Feest et al., *Metals Technology,* April, 1983, Vol. 10, Pages 121–124, "Microstructural Characterization Of Cast Nickel Aluminium Bronze" by Culpan et al., *Journal Of Materials Science,* (1978), Pages 1647–1657, "Tempering Of Cast Nickel-Aluminium Bronze" by Hasan et al., *Metal Science,* Vol. 17, June, 1983, Pages 289–295, "The Metallography Of Fracture In Cast Nickel Aluminium Bronze" by Culpan et al., *Journal of Materials Science,* (1978), Pages 323–328, "The Creep And Fatigue Properties Of Some Wrought Complex Aluminium Bronzes" by McKeown et al., *Journal Of The Institute Of Metals,* Vol. 83, Pages 69–79, and "The Fracture Toughness Of A Nickel-Aluminium Bronze" by Barnby et al., *Journal of Materials Science,* (1977), Pages 1857–1861. The following patents and publications are also of interest though they are not believed to be as pertinent as those previously described: U.S. Pat. Nos. 1,906,567 to Fritschle, 2,778,733 to Frejacques, and U.K. Pat. No. 1,289,301 to Richardson et al., Japanese Pat. No. 46-42304 and Australia No. 249,261. A detailed investigation of copper-nickel-aluminum alloys is described in a series of articles by Alexander et al. appearing in the *Journal Of The Institute Of Metals* at Vol. 61, Pages 83 to 102, Vol. 63, Pages 163 to 189 and Vol. 64, Pages 217 to 230. The following publications are also of interest: "Influence Of Microstructure On The Stress-Strain Behaviour Of Two-Phase Copper-Rich Cu-Al Alloys" by Linden, *Materials Science And Engineering,* (1979), Pages 5–14, "Zerfall Martensitischer Phasen In Aluminiumbronzen" by Hunger et al., *Z. Metallkde.,* (1960), Pages 394–403, and *Alloy Digest.* AMPCOLOY 570, March, 1980.

In accordance with the present invention a predominately beta copper base alloy has been found which can be processed in accordance with this invention to form the desired microstructure so that it is adapted to semi-solid metal slurry forming processes. The alloy is adapted to have from about 10% to about 30% liquid phase during slurry forming. In accordance with one aspect of the present invention the alloy consists essentially of from about 9% to about 10.5% by weight aluminum, at least about 10% by weight nickel and the balance essentially copper. In accordance with another aspect of this invention a portion of the nickel may be replaced on about a one for one basis by iron provided that the total content of nickel plus iron is at least about 10%. In accordance with this embodiment the copper base alloy consists essentially of from about 9% to about 10.5% by weight aluminum, from about 3% to about 7% by weight nickel, from about 3% to about 7% by weight iron, with the total nickel and iron contents being at least about 10%, balance essentially copper.

It has surprisingly been found in accordance with this invention that when the aforenoted alloys are cast and rapidly cooled in accordance with the process of this invention the first noted alloy containing copper, nickel and aluminum forms an equiaxed dendritic structure as cast comprising a nickel and aluminum rich particulate within a matrix comprising phases poor in nickel and aluminum. When this alloy is heated above its solidus temperature to the semi-solid slurry forming temperature region, the particles comprise a beta phase and liquid matrix derived from an alpha plus beta phase eutectic. It has surprisingly been found that such predominately beta alloys can provide the desired strength for applications such as cartridge cases without requiring age hardening. However, it is possible with such alloys to solution treat and age to provide increased strength and ductility.

The second noted alloy, when cast by the process of this invention employing rapid cooling, produces an equiaxed dendritic structure which is somewhat obscured by martensitic transformation. However, when this alloy is reheated to a semi-solid condition and quenched, the desired press forgeable microstructure is obtained. Accordingly, it is possible with the process of this invention utilizing the alloys within the aforenoted composition ranges to provide the alloy with a desired press forgeable microstructure without the necessity of stir casting.

It is preferred in accordance with the present invention that the alloy in accordance with the first embodiment consists essentially of from about 9% to about 10% by weight aluminum, from about 10% to about 12% by weight nickel and the balance essentially copper. The alloy in accordance with the second embodiment should preferably have a composition consisting essentially of from about 9% to about 10% by weight aluminum, from about 4% to about 6% by weight nickel, from about 4% to about 6% by weight iron, with the combined nickel plus iron content being from about 10% to about 12%.

The process in accordance with the present invention comprises chill casting the copper alloys within the aforenoted ranges so that they are cooled at a critical cooling rate comprising at least about 10° C./sec. and preferably about 13° C./sec. In order to achieve these high cooling rates, the thickness of the casting should be limited to less than about 1" and, preferably, about a ½" or less. The alloys are then reheated to a semi-solid condition as part of a press forging operation or as a separate reheating step. When the alloys are thusly reheated they form the desired microstructure suitable for press forging. Preferably, the reheated period is less than about 15 minutes and, most preferably, less than about 10 minutes in order to insure that the desired microstructure is retained or formed.

After press forging the alloy, if desired, it can be age hardened. It may be possible for the press forging operation to comprise a solutionizing treatment. Alternatively, the alloys can be solution treated and quenched after press forging. Following solutionizing the alloys are age hardened by heating to a moderate temperature.

In accordance with this invention copper base alloys are provided which are adapted to be formed as a semi-solid slurry by techniques such as press forging. In the background of this application there has been briefly discussed techniques for forming semi-solid metal slurries by casting, forging, etc. Such slurries are often referred to as "thixotropic" since within certain ranges of volume fraction of liquid they behave in a thixotropic manner. Accordingly, sometimes forging of such slurries is referred to as "thixoforging" and casting of such slurries is referred to as "thixocasting" or "rheocasting".

The copper base alloys of the present invention are adapted to form a semi-solid slurry when heated to a temperature between their liquidus and solidus temperatures. The alloys preferably have a microstructure comprising discrete particles within a lower melting point matrix. These particles comprise solid particles and are made up of a single phase or a plurality of phases having an average composition different from the average composition of the generally surrounding matrix in the fully solidified alloy. The discrete particles are contained in a generally surrounding matrix which is solid when the alloy is fully solidified and which is liquid when the alloy has been heated to form a semi-solid slurry. The matrix itself comprises one or more phases having a lower melting point than the discrete particles.

Conventionally solidified alloys generally have branched dendrites which develop interconnected networks as the temperature is reduced and the weight fraction of solid increases. In contrast, the alloys forming the semi-solid metal slurries of this invention comprise discrete particles separated from each other by a liquid metal matrix. The discrete solid particles are characterized by smoother surfaces and a less branched structure than normal dendrites, approaching a spheroidal configuration. The surrounding solid matrix is formed during solidification of the liquid matrix and comprises dendrites, single or multi-phased compounds, solid solution, or mixtures of dendrites, and/or compounds, and/or solid solutions. In accordance with this invention the term "surrounding matrix" refers to the matrix in which the discrete particles are contained and it need not fully surround each particle. Therefore, the term "surrounding" should be read as generally surrounding.

Semi-solid slurries can be formed into a wide variety of possible shapes by techniques such as forging, die casting, etc. The semi-solid slurries in accordance with this invention by virtue of their structure comprising discrete particles within a molten matrix avoid problems relating to the separation of solids and liquids and thereby insure that uniform properties are obtained. The use of semi-solid slurries in press forging or die casting provides improved die life and reduced thermal shock effects during processing. In accordance with the present invention, it is possible to produce thin wall parts such as cartrdige cases by press forging the alloy.

Alloys which are suited to forming in a semi-solid state must have particular combinations of properties not required for other processes such as die casting and conventional forging. For example, it is preferred that the alloys have a wide solidification range which comprises the temperature differential between the liquidus and solidus temperatures of the alloy. The alloy should preferably have from about 10% to about 30% of nonequilibrium eutectic phase so that the volume fraction of solid can be controlled upon heating the alloy to a semi-solid condition for forging. This range of volume fraction or percent of nonequilibrium eutectic phase corresponds to the range of volume percent liquid in the slurry upon heating to the semi-solid state. High fluidity of the molten alloy matrix is desired in order to minimize porosity in the finished part. Preferably, the alloy is precipitation hardenable in order to permit high strength to be attained without the necessity of cold working the resultant forged part. Improved thermal conductivity is advantageous for facilitating reheating to a uniform temperature before forging.

In the background of this application, a U.S. application to Pryor et al. has been described wherein certain copper-nickel-aluminum alloys have been formed into castings with a microstructure comprising discrete particles contained in a lower melting point matrix. Pryor et al. also disclose techniques for forming such alloys by forging into parts such as cartridge cases. The alloy slugs which are heated to the semi-solid region for press forging parts such as cartridge cases generally have a small diameter of an inch or less for small cartridge cases. Slug diameters of ½" or less are particularly suited for 38 caliber cartridge cases. MHD stirring in accordance with the Winter et al. U.K. patent application noted in the background is difficult to perform for manufacturing such small diameter slugs. Therefore, in accordance with this invention it has been found that certain alloys within restricted ranges of composition are capable of being cast in accordance with the process of this invention so that their microstructure as cast or when reheatcd in accordance with the process of this invention to the semi-solid region is suitable for press forging. Accordingly, it is possible with the alloys of this invention to avoid the necessity of MHD or other type stir casting processes to obtain the desired semi-solid slurry.

The alloys in accordance with the present invention comprise predominately beta alloys having nonequilibrium microstructures such that the semi-solid slurry is believed to be comprised of discrete particles comprising a beta phase and the molten lower melting point matrix is believed to comprise alpha plus beta phase. The alloys of this invention are adapted to form semi solid slurries having from about 10% to about 30% liquid phase.

In accordance with one embodiment of the present invention, the copper base alloy consists essentially of from about 9% to about 10.5% by weight aluminum, at least about 10% by weight nickel and the balance essentially copper.

The lower limit for aluminum is set so that the alloy will be a predominately beta alloy. Lower aluminum contents result in the alloy becoming predominately an alpha alloy. The upper limit for aluminum is set in order to obtain an alpha plus beta matrix. Higher contents of aluminum would yield a purely beta alloy having reduced ductility. The lower limit for nickel is determined by the necessity of obtaining generally equiaxed grains on solidification in order to provide the desired semi-solid slurry without the necessity of stir casting.

Preferably, the copper base alloy in accordance with the first embodiment of this invention consists essentially of from about 9% to about 10% by weight aluminum, from about 10% to about 12% by weight nickel and the balance essentially copper. The upper range for nickel in accordance with the preferred embodiment is associated with the excessive cost of that element as an alloying addition.

In accordance with a second embodiment of this invention a portion of the nickel may be replaced on a one for one basis by iron provided that the total content of nickel plus iron is at least about 10%. In accordance with this embodiment the copper base alloy consists essentially of from about 9% to about 10.5% by weight aluminum, from about 3% to about 7% by weight nickel, from about 3% to about 7% by weight iron with the total nickel and iron contents being at least about 10%, balance essentially copper. Preferably the alloy in accordance with the second embodiment should have a composition consisting essentially of from about 9% to about 10% by weight aluminum, from about 4% to about 6% by weight nickel, from about 4% to about 6% by weight iron with the combined nickel plus iron content being from about 10% to about 12% and the balance essentially copper. The limits for the alloying elements in accordance with the second embodiment have been established on essentially the same basis as in the previous embodiment upon considering the combined amounts of iron and nickel in the same sense as the nickel addition of the previous embodiment. The substitution of iron for nickel helps to reduce the cost of the alloy.

The process in accordance with the present invention comprises chill casting the copper alloys within the aforenoted ranges so that they are cooled at a critical cooling rate comprising at least about 10° C./sec. and, preferably, at least about 13° C./sec. It has surprisingly been found that a cooling rate of 7° C./sec. does not provide the resultant alloy with the desired press forging structure. In order to achieve these high cooling rates the thickness of the casting should be limited to less than about 1" and, preferably, about ½" or less. In order to assure the desired press forging structure the alloys are heated to a semi-solid condition, namely they are heated to a temperature of at least about 1030° C. wherein the resultant alloy comprises discrete particles within a molten matrix as previously described. Since the structure which is desired in accordance with this invention is a nonequilibrium one the period during which the alloys are heated is preferably less than about 15 minutes and most preferably less than about 10 minutes. The use of these short heating intervals insures that the desired microstructure is retained or formed as the case may be. The aforenoted heating step may be performed after casting, separate from the press forging operation or it can be performed as part of the press forging operation, namely the step of heating the alloy slug to the semi-solid temperature region in order to form the semi-solid slurry which is then press forged.

For some applications the use of predominately beta alloys as compared to the predominately alpha alloys results in a strength as press forged which is sufficient for the ultimate application, for example, a cartridge case. However, if desired, the alloys in accordance with this invention may be age hardened to increase their strength. The age hardening treatment can comprise solutionizing followed by aging or the solutionizing treatment may be performed by quenching following press forging.

The chill casting step in accordance with this invention can comprise any well-known chill casting approach wherein the alloying elements are melted together at a temperature preferably above about 1200° C. and then poured into a chill mold which can comprise a static casting mold or a continuous or semicontinuous casting mold. The section size of the casting is limited by the necessity of achieving the aforenoted cooling rates throughout the cross section. If the cooling rates are not achieved throughout the cross section, then a portion of the casting will not have the desired microstructure.

It has surprisingly been found that when the aforenoted alloys are cast and rapidly cooled in accordance with the process of this invention alloys in accordance with the first embodiment form an equiaxed dendritic microstructure as cast comprising a nickel and aluminum rich particulate within a matrix comprising phases poor in nickel and aluminum. When this alloy is heated above its solidus temperature to the semi-solid slurry forming temperature, namely above about 1030° C. and held thereat for the limited period previously described, the resultant particles comprise a beta phase and the matrix comprises alpha plus beta phases eutectic.

The alloys in accordance with the second embodiment of this invention when cast by the process herein, produce an equiaxed dendritic structure which is somewhat obscured by martensitic transformations. However, when this alloy is reheated to a semi-solid condition and quenched, the desired press forgeable microstructure is obtained.

The alloys of the present invention having the desired microstructure can be formed in a semi-solid condition wherein the alloy has a volume fraction of from about 10% to about 30% liquid comprising a molten metal matrix. This minimizes significant changes in the volume fraction liquid at the forging temperature as a function of small variations in temperature. It also provides better dimensional tolerance and improved die life.

Solutionizing in accordance with this invention preferably is carried out by heating the alloy to a temperature of at least about 800° C. for a time period of 5 minutes to 4 hours. Preferably, the alloy is heated to a temperature in the range of 800° C. to about 1000° C. for about 5 minutes to about 2 hours. After solutionizing the alloy is preferably quenched in water. If the solutionizing is carried out as part of the forging operation, then the alloy is preferably quenched immediately following forging.

After solutionizing the alloy is preferably subjected to an aging treatment wherein it is heated to a temperature in the range of from about 350° C. to about 700° C. for a time period of from about 1 minute to about 10 hours and, preferably, it is heated to a temperature of from about 400° C. to about 600° C. for about 5 minutes to about 3 hours.

When the alloys of the present invention are subjected to the aforenoted precipitation hardening treatment, they are capable of achieving a tensile strength of at least about 115 ksi.

Preferably, in accordance with this invention the alloys are formed into parts such as cartridge cases comprising thin walled elongated members. Preferably, the member has a cup-shaped configuration typical of a cartridge case. However, if desired, the alloy of the present invention can be utilized to form any desired component by the techniques which have been described.

The present invention will be more readily understandable from a consideration of the following illustrative examples.

EXAMPLE I

Referring to Table I, a series of alloys having nominal compositions as shown therein were chill cast with a cooling rate throughout the cross section of the resulting ingot of about 13° C./sec. The alloys were prepared in a conventional fashion by melting together the respective elements. The pouring temperature of the casting comprised about 1300° C. The tensile properties of the as-cast materials are also shown in the table. The alloys were also aged at a temperature of 600° C. for a period of 1 hour and the tensile properties were measured.

TABLE I

| Nominal Composition | | | | Tensile Properties | | | | | |
|---|---|---|---|---|---|---|---|---|---|
| | | | | As-Cast | | | Aged | | |
| Alloy | Al | Ni | Fe | YS ksi | UTS ksi | % Elong. | YS | UTS | % Elong. |
| A | 10 | 5 | — | — | — | — | — | — | — |
| B | 10 | 10 | — | 72 | 102 | 8 | 84 | 134 | 11 |
| C | 10 | 5 | 5 | 77 | 118 | 10 | 86 | 139 | 16 |

It has been found that aging at 500° C. or 700° C. typically provided lower strength and ductility than shown above.

It is apparent from a consideration of Table I that the alloys of the present invention provide high strength in the as-cast condition and even higher strength as aged. Alloy A had a microstructure comprising coarse columnar dendrites. Alloy B had a microstructure comprising equiaxed fine dendrites which should be press forgeable. Alloy C, which comprises Alloy A with the addition of 5% iron, had equiaxed dendrites obscured by martensitic transformations which when reheated in accordance with this invention produced a press forgeable microstructure. Upon reheating to the semi-solid condition for less than 15 minutes the microstructures of Alloys B and C comprised the desired nonequilibrium microstructure comprising preferably beta phase discrete particles within a matrix comprising alpha plus beta phases.

EXAMPLE II

Referring now to Table II, the alloys prepared in accordance with Example I were heat treated as follows: The as-cast alloys were solution treated by heating them to a temperature of about 1000° C. for a period of about 1 hour followed by quenching. The tensile properties of the solution treated alloys were then measured and are set forth in Table II. The alloys were then aged at a temperature of 600° C. for a period of 1 hour and the tensile properties were again measured.

TABLE II

| | Tensile Properties | | | | | |
|---|---|---|---|---|---|---|
| | Solution Treated | | | Aged | | |
| Alloy | YS | UTS | % Elongation | YS | UTS | % Elongation |
| B | 102 | 102 | — | 89 | 125 | 10 |
| C | 82 | 122 | 12 | 89 | 127 | 6 |

It is apparent from a consideration of Table II that the alloys in accordance with the present invention can be age hardened to increase their strength.

Preferably, the discrete particles in accordance with this invention have a generally spherical shape. This is particularly the case after the reheating step.

The term "ksi" as used herein comprises thousands of pounds per square inch. "YS" stands for yield strength at 0.2% offset. "UTS" stands for ultimate tensile strength.

The patents, patent applications, and articles set forth in this specification are intended to be incorporated by reference herein.

It is apparent that there has been provided in accordance with this invention a beta copper base alloy adapted to be formed as a semi-solid metal slurry which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A predominately beta phase copper base alloy adapted for forming in a semi-solid slurry condition, said alloy having a microstructure comprising discrete particles contained in a matrix having a lower melting point than said particles, said alloy consisting essentially of from about 9% to about 10.5% by weight aluminum, from about 3% to about 7% by weight nickel, from about 3% to about 7% by weight iron with the total nickel and iron contents being at least about 10%, balance essentially copper.

2. An alloy as in claim 1 which is in a chill cast condition wherein said alloy consists essentially of from about 9% to about 10% by weight aluminum, from about 4% to about 6% by weight nickel, from about 4% to about 6% by weight iron with the combined nickel plus iron content being from about 10% to about 12% and the balance essentially copper, said alloy being adapted to form said desired microstructure without stirring during casting.

3. An alloy as in claim 2 which is also in a thixoforged condition.

4. An alloy as in claim 2 which is in an aged condition.

5. An alloy as in claim 3 which is in a solution treated and aged condition.

6. An alloy as in claim 3 wherein said particles comprise a beta phase and wherein said matrix comprises a eutectic having alpha and beta phases.

7. An alloy as in claim 1 wherein said slurry condition comprises from about 10% to about 30% volume fraction liquid which when solidified comprises said matrix.

8. An alloy as in claim 1 which comprises a cartridge case comprising an elongated thin walled member.

* * * * *